US008992169B2

(12) United States Patent
Metscher

(10) Patent No.: US 8,992,169 B2
(45) Date of Patent: Mar. 31, 2015

(54) LAYER SYSTEM FOR ROTOR/STATOR SEAL OF A TURBOMACHINE AND METHOD FOR PRODUCING THIS TYPE OF LAYER SYSTEM

(75) Inventor: Martin Metscher, Munich (DE)

(73) Assignee: MTU Aero Engines GmbH, Munich (DE)

( * ) Notice: Subject to any disclaimer, the term of this patent is extended or adjusted under 35 U.S.C. 154(b) by 777 days.

(21) Appl. No.: 13/233,437

(22) Filed: Sep. 15, 2011

(65) Prior Publication Data

US 2012/0087781 A1 Apr. 12, 2012

(30) Foreign Application Priority Data

Oct. 11, 2010 (DE) ..... 10 2010 048 147

(51) Int. Cl.
*F01D 11/12* (2006.01)
*F01D 11/08* (2006.01)
*F01D 5/28* (2006.01)

(52) U.S. Cl.
CPC ..... *F01D 11/08* (2013.01); *F01D 5/288* (2013.01); *F01D 11/122* (2013.01); *F05B 2230/90* (2013.01)
USPC ..... 415/174.4

(58) Field of Classification Search
CPC ..... F01D 5/288; F01D 11/008; F01D 11/122; F05B 2230/90
USPC ..... 415/173.4, 174.4
See application file for complete search history.

(56) References Cited

U.S. PATENT DOCUMENTS

| | | | | |
|---|---|---|---|---|
| 4,299,865 | A | 11/1981 | Clingman et al. | |
| 4,422,648 | A | 12/1983 | Eaton et al. | |
| 5,388,959 | A * | 2/1995 | Forrester et al. | 415/173.4 |
| 8,727,712 | B2 * | 5/2014 | Strock et al. | 415/173.4 |

FOREIGN PATENT DOCUMENTS

| | | | |
|---|---|---|---|
| DE | 10225532 | C1 | 12/2003 |
| DE | 69926838 | T2 | 3/2006 |
| DE | 102004050474 | A1 | 4/2006 |
| DE | 202005020695 | U1 | 6/2006 |
| EP | 1367147 | A1 | 3/2003 |

* cited by examiner

*Primary Examiner* — Edward Look
*Assistant Examiner* — Aaron R Eastman
(74) *Attorney, Agent, or Firm* — Barlow, Josephs & Holmes, Ltd.

(57) ABSTRACT

The present invention creates a layer system for the rotor/stator seal of a turbomachine, in particular a compressor, which is disposed between components of the turbomachine and can be run in with a movement of the components relative to one another, in such a way that at least one of the components is run into the layer system, having: a first adhesive layer disposed on at least one of the components; a protective layer disposed on the first adhesive layer; a second adhesive layer disposed on the protective layer; and a running-in layer, which is formed softer than the protective layer and which is disposed on the second adhesive layer. The present invention further provides a method for producing a layer system for the rotor/stator seal of a turbomachine, as well as a turbomachine.

7 Claims, 2 Drawing Sheets

LAYER SYSTEM FOR ROTOR/STATOR SEAL OF A TURBOMACHINE AND METHOD FOR PRODUCING THIS TYPE OF LAYER SYSTEM

CROSS REFERENCE TO RELATED APPLICATION

N/A

BACKGROUND OF THE INVENTION

The present invention relates to a layer system for the rotor/stator seal of a turbomachine, in particular a compressor, a method for producing this type of layer system, and a turbomachine, in particular a compressor having this type of layer system.

Although it is applicable to any turbomachine, the present invention as well as its underlying problem will be explained in more detail with reference to a compressor.

In running in shroud-free compressor guide vanes of a stator into a rotor of a turbomachine, the requirements that are to be fulfilled include protecting the rotor from damage and simultaneously enabling a running in of the compressor guide vanes into the rotor that is as deep as possible in order to assure an optimized running gap between the tips of the compressor guide vanes and the rotor. This must not lead to damage of the compressor guide vanes, however.

DE 102 25 532 C1 describes a layer system for a rotor/stator seal of a turbomachine, in particular a gas turbine, which is introduced onto a metal component and can be run in opposite another component that can move relative to it, and, which is characterized by an adhesive layer introduced on the metal component as well as a running-in coating comprising at least two layers introduced thereon for improving the service life and the running-in capability, whereby the first layer delimiting the adhesive layer is harder relative to the second layer and whereby the second layer can be run in.

DE 20 2005 020 695 U1 describes a layer system for protecting components of gas turbines from oxidation and corrosion. The layer system has a metal bonding layer for binding to a substrate and an inner ceramic layer introduced on the metal bonding layer as well as outer ceramic layer introduced on the inner ceramic layer.

DE 10 2004 050 474 A1 describes a method for producing a component that is coated with an anti-wear coating, in particular an anti-corrosion coating or an anti-erosion coating, in particular a gas-turbine component, with the steps: providing a component to be coated on one component surface; at least partially coating the component on its component surface with an anti-wear coating of at least two layers, whereby the anti-wear coating comprises at least one relatively soft layer and at least one relatively hard layer; and surface hardening the at least partially coated component on its coated surface.

It is a disadvantage in these systems that the covering layer is extremely hard and only an extremely limited running in would be possible without massive damage to the vane or the coating. In fact, if a rotor protection were to be assured, the guide vanes would be abrasively worn, however. Understandably, this should be prevented.

SUMMARY OF THE INVENTION

Proceeding from this, the problem of the present invention is to provide an improved layer system for the rotor/stator seal.

This problem is solved according to the invention by a layer system with the features of patent claim 1 and/or by a method with the features of patent claim 7.

Accordingly, a layer system, which is disposed between components of the turbomachine, is provided for the rotor/stator seal of a turbomachine, in particular a compressor, and this system is capable of being run in with a movement of the components relative to one another in such a way that at least one of the components is run into the layer system, having: a first adhesive layer disposed on at least one of the components; a protective layer disposed on the first adhesive layer; a second adhesive layer disposed on the protective layer; and a running-in layer, which is formed softer than the protective layer and which is disposed on the second adhesive layer.

Further, a method for producing a layer system for the rotor/stator seal of a turbomachine, in particular a compressor, is provided, the layer system being disposed between components of the turbomachine and being capable of being run in with a movement of the components relative to one another, in such a way that at least one of the components is run into the layer system, with the following method steps: introducing a first adhesive layer on at least one of the components; introducing a protective layer onto the first adhesive layer; introducing a second adhesive layer onto the protective layer; and introducing a running-in layer, which is formed softer than the protective layer, onto the second adhesive layer.

The concept that is the basis of the present invention consists in functionally decoupling the protective layer and the running-in layer from one another. The second adhesive layer is provided for this purpose between the protective layer and the running-in layer. The tasks of the protective layer and the running-in layer can be optimized by means of this functional decoupling of these layers from one another. For example, completely different materials, which cannot be directly bonded to one another, can be used for the protective layer and the running-in layer.

Advantageous enhancements result from the subclaims.

According to a preferred enhancement of the layer system, the components are formed as a stator and a rotor of the turbomachine, the layer system being disposed on the rotor, and the stator being able to be run into the layer system. This reliably prevents a mechanical damaging of the rotor.

According to another preferred enhancement of the layer system, the first adhesive layer is formed as a metal adhesive layer and/or the second adhesive layer is formed as a metal adhesive layer, whereby advantageously, a reliable binding of the protective layer to the rotor is assured as well as a secure binding of the protective layer to the running-in layer. The operating reliability and the service life of the layer system are increased in this way.

According to another preferred enhancement of the layer system, the protective layer and the running-in layer are formed as ceramic layers. In this way, advantageously, a heat resistance and a corrosion resistance of the layer system are also assured at high operating temperatures of the turbomachine.

According to another preferred enhancement of the layer system, the protective layer and/or the running-in layer are formed with aluminum oxide and/or zirconium oxide. Advantageously, the desired material properties of the protective layer and of the running-in layer can be adjusted in this case.

According to another preferred enhancement of the layer system, the running-in layer, in contrast to the protective layer, has a porosity or has a higher porosity than the protective layer, by which means the hardness of the running-in layer can be adjusted advantageously.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

In the figures of the drawing, identical elements and features, as well as those that are functionally identical, are provided with the same reference numbers, unless otherwise stated.

DETAILED DESCRIPTION OF THE PREFERRED EMBODIMENT

Figure 1:
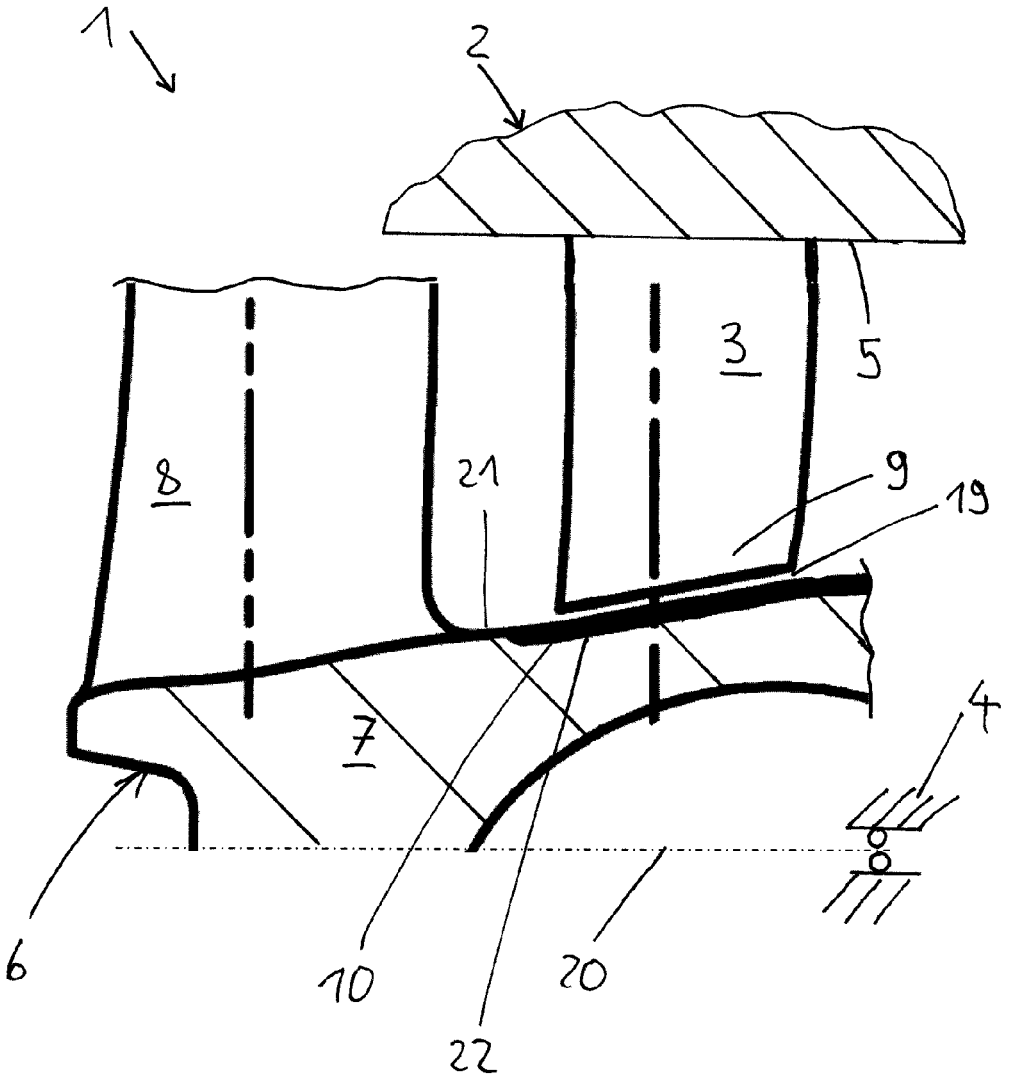
FIG. 1 shows a partial section of a turbomachine according to a preferred embodiment of the present invention.

In the figures of the drawing, identical elements and features, as well as those that are functionally identical, are provided with the same reference numbers, unless otherwise stated.

In a partial sectional view, FIG. 1 illustrates a turbomachine 1, in particular a compressor 1. The turbomachine 1, for example, has a first component 6, which is preferably designed as a rotor 6 of the turbomachine 1, and a second component 2, which is designed, for example, as a stator 2 of the turbomachine 1. The components 2, 6 are movable relative to one another. Preferably, the rotor 6 can be rotated around a central axis 20 in a housing 4, in particular in a compressor housing 4 of the turbomachine 1. For example, the rotor 6 has a hub 7 and compressor blades operatively connected to the hub 7; of these only one compressor blade 8 is shown. The compressor blades are preferably disposed around a circumference of the hub, uniformly distanced from one another. The rotor 6, for example, comprises a metal alloy based on titanium, nickel or cobalt.

The stator 2 is preferably designed as a stator 2 with shroud-free guide vanes, in particular with shroud-free compressor guide vanes, of which only one guide vane 3 is shown. The stator 2, for example, is an integral component of the housing 4 of the turbomachine 1. The guide vanes are preferably disposed, uniformly distanced radially from one another, in a circumferential direction of a stator bore 5. The rotor 6 of the turbomachine 1 is preferably guided through the stator bore 5. For simplification, in the following, reference is made to only one guide vane 3. A running gap 19, in particular a compressor gap 19, is formed between a guide vane tip 9 of the guide vane 3 and the rotor 6, in particular, the hub 7. In order to obtain the best rotor/stator seal possible, the running gap 19 must be as small as possible.

In the region of the running gap 19, a layer system 10, which can be run in, is preferably disposed on one of the components 2, 6. This means that. with a movement of the components 2, 6 relative to one another, at least one of the components 2, 6, for example, due to a dimensional change induced by speed and/or heat and without damaging the component 2, 6, can penetrate into the layer system 10 and abrade or wear away the latter in a controlled manner. A running gap 19 that is as small as possible can be obtained in this way, by which means both the efficiency as well as the aerodynamic stability of the turbomachine 1 is improved. The layer system 10 is bonded to the component 2, 6, for example, in a force-fitting, material-fitting and/or form-fitting manner. The layer system 10 can be at least partially an integral component part of the component 2, 6. The layer system 10, for example, is chemically or metallically bonded to the component 2, 6. For example, the layer system 10 can be disposed on both components 2, 6. In a preferred embodiment of the turbomachine 1, the layer system 10 is disposed on a surface 21 of the rotor 6, in particular on the hub 7 of rotor 6. For this purpose, for example, a groove 22, in particular an annular groove 22, is provided on the surface 21 of the rotor 6, for taking up the layer system 10. The layer system 10 may also be disposed on the stator 2. Only the layer system 10 with reference to the rotor 6 will be explained in the following, by way of example.

Figure 2:
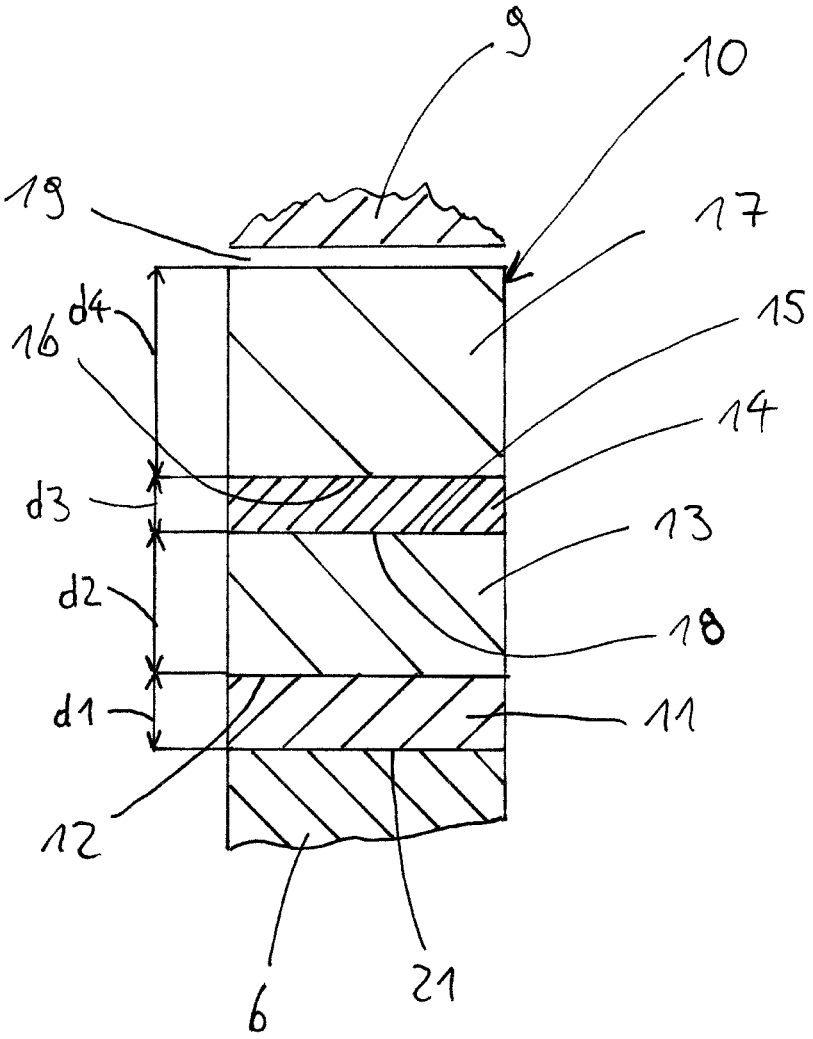
FIG. 2 shows a detail view of a layer system according to a preferred embodiment of the present invention.

FIG. 2 illustrates a preferred embodiment of the layer system 10 in an enlarged partial-section view. A first adhesive layer 11 of the layer system 10 is disposed on the surface 21 of the rotor 6 of the turbomachine 1. The first adhesive layer 11 is preferably formed as a metal adhesive layer 11. For example, the first adhesive layer 11 is formed with an MCrAlY alloy. Here, the letter M particularly stands for nickel and/or cobalt. The first adhesive layer 11 is bonded, for example, metallically or mechanically to the surface 21 of the rotor 6. For example, the first adhesive layer 11 can be applied onto the rotor 6 my means of a plasma spray process, in particular by means of high-velocity flame spraying (HVOF). The first adhesive layer 11 preferably has a defined roughness on the surface side, in the form of a porosity, on one surface 12 pointing away from the rotor 6. The porosity of the first adhesive layer 11 preferably decreases toward the surface 21 of the rotor 6. The first adhesive layer 11 may also be monolithic, i.e., without porosity. The adhesive layer 11, for example, has a layer thickness d1 of 0.25-0.4. The surface properties of the surface 12 of the first adhesive layer 11 can be adjusted, for example, by means of abrasive processing methods, such as, for example, grinding, sand-blasting, or the like. The surface 12 may also be chemically treated, for example, by means of an etching method.

A protective layer 13 is disposed on the first adhesive layer 11. The protective layer 13 is mechanically joined with the first adhesive layer 11, for example, by means of the surface roughness of the surface 12 of the first adhesive layer 11. The protective layer 13 is preferably designed as a ceramic layer 13. The protective layer 13 preferably has a high hardness and mechanical resistance capacity. The protective layer 13 serves for the protection of the rotor 6 from mechanical damage. For this purpose, the protective layer 13 is optimized with respect to its material properties for the greatest possible protection of the rotor 6. Preferably, the protective layer 13 is formed with a ceramic material, in particular with yttrium-stabilized zirconium oxide or aluminum oxide. Of course, any other materials or material combinations can be used for the protective layer 13. The protective layer 13 preferably has a porosity. The protective layer 13, for example, has a porosity in the range of 5-20 vol. %, especially in the range of 15-20 vol. %. Preferably, the protective layer 13 has no porosity gradient, i.e., the porosity of the protective layer 13 is preferably constant over its entire layer thickness d2. Alternatively, the protective layer 13 is monolithic, for example, i.e., the protective layer 13 has no porosity or almost no porosity. The protective layer 13, for example, has a layer thickness d2 of 0.2-10 mm and especially of 0.5-0.8 mm. The surface properties of a surface 18 of the protective layer 13 can be adjusted analogously to the surface properties of the first adhesive layer 11.

A second adhesive layer 14 is preferably disposed on the protective layer 13. The second adhesive layer 14, for example, is also formed analogously to the first adhesive layer 11 as a metal adhesive layer 14. The second adhesive layer 14 may have the same material as the first adhesive layer 11 or alternatively can be formed with another material. The second adhesive layer 14 can be formed with a ceramic material. The second adhesive layer 14, for example, serves as a bonding agent and as a functional separating element between the protective layer 13 and a running-in layer 17 of the layer system 10. The second adhesive layer 14 functionally decouples the layers 13, 17 from one another. Depending on the selection of material for the layers 13, 17 to be joined in each case, the second adhesive layer 14 may also be dispensed with. The selection of the material of the second adhesive layer 14 is dependent on the type and the selection of material for the layers 13, 17 to be joined. The second adhesive layer 14 preferably has a thickness d3 of 0.25-0.4 mm. The second adhesive layer 14 preferably has a roughness defined by a porosity on a surface 15 facing the protective layer 13. In this way, a mechanical joining to the protective layer 13 is assured. The second adhesive layer 14 also has a roughness defined by porosity on a surface 16 of this layer facing away from the protective layer 13. The second adhesive layer 14 preferably has a porosity gradient, by which means a different roughness is obtained on the two surfaces 15, 16 of the second adhesive layer 14. Alternatively, the second adhesive layer has the same roughness on both surfaces 15, 16. The second adhesive layer 14 may also be formed monolithic, i.e., without porosity. For example, the surface 16 can be processed analogously to the surfaces 12, 18.

The running-in layer 17 is disposed on the second adhesive layer 14. The running-in layer 17 preferably has a lower hardness than the protective layer 13. The running-in layer 17 is preferably formed as a ceramic layer 17, in particular as a layer 17 formed with yttrium-stabilized zirconium oxide and/or with aluminum oxide. For example, the running-in layer 17 is formed with another material as the protective layer 13. Alternatively, the layers 13, 17 can be formed with the same material. Preferably, the running-in layer 17 has a porosity in the range of 20-35 vol. %. The porosity of the running-in layer 17 is preferably greater than the porosity of the protective layer 13, by which means a greater softness of the running-in layer 17 is attained in comparison to the protective layer 13. The porosity of the running-in layer 17 can be adjusted, for example, by means of an addition of plastic particles, in particular polystyrene particles, which will be burned out in a sintering process of the running-in layer 17.

The functioning of the layer system 10 will be explained briefly in the following: The layer system 10 preferably serves for the sealing between the two components 2, 6, in particular between the stator 2 and the rotor 6, of the turbomachine 1. That is, the running gap 19 between the guide vane tip 9 of the guide vane 3 and the rotor 6 will be as small as possible. For example, the layer system 10 is introduced on the rotor 6. The rotor 6 is mounted in the housing 4 of the turbomachine 1, whereby an initial running gap 19 results between the layer system 10 and the guide vane tip 9. In a running-in process, i.e., when the turbomachine 1 is started up, whereby the rotor 6 and the stator 2 are placed in a motion relative to one another, the rotor 6 and/or the stator 2 undergo geometric changes, for example, plastic and/or elastic deformations based on heat expansion, centrifugal forces, and/or setting processes or the like. In this way, the guide vane tip 9 comes into contiguous contact with the layer system 10. Since the running-in layer 17 is soft and optimized with respect to the running-in behavior, the guide vane tip 9 is run into the running-in layer 17 of the layer system 10 without mechanical damage to the tip. The running-in layer 17 is at least partially abraded in this way. A layer thickness d4 of the running-in layer 17 is thus formed in such a way that the guide vane tip preferably does not contact the second adhesive layer 14. If the guide vane tip 9, however, should completely penetrate the running-in layer 17 and the second adhesive layer 14, then the hard protective layer 13 reliably prevents a running in of the guide vane tip 9 into the base material of the rotor 6, or into the surface 21 of the rotor 6. In this case, the guide vane 3 will be abraded at its guide vane tip 9. The rotor 6 is thus protected from damage. Based on the functional decoupling of the protective layer 13 from the running-in layer 17 by means of the second adhesive layer 14, both the requirement for the layer system 10 with respect to the protection of the rotor 6 and the optimized running-in behavior of the guide vane tip 9 into the running-in layer 17 can be optimized each time independently of one another. Therefore, a smaller, optimized running gap 19 is feasible, by which means both the efficiency as well as the aerodynamic stability of a turbomachine 1 are improved with this type of layer system 10. The higher hardness of the protective layer 13 when compared with the running-in layer 17, further improves the erosion resistance, the thermal cycling resistance, and thus the durability of the layer system 10.

It would be appreciated by those skilled in the art that various changes and modifications can be made to the illustrated embodiments without departing from the spirit of the present invention. All such modifications and changes are intended to be covered by the appended claims.

What is claimed is:

1. A layer system (10) for the rotor/stator seal of a turbomachine (1), which is disposed between components (2, 6) of the turbomachine (1) and is capable of being run in with a movement of the components (2, 6) relative to one another, in such a way that at least one of the components (2, 6) is run into the layer system (10), comprising:

a first adhesive layer (11) disposed on a rotor of a turbomachine;

a protective layer (13) disposed on the first adhesive layer (11);

a second adhesive layer (14) disposed on the protective layer (13); and a running-in layer (17), which is formed softer than the protective layer (13) and which is disposed on the second adhesive layer (14);

wherein a stator (2) of the turbomachine is able to be run into the layer system (10).

2. The layer system according to claim 1, wherein the first adhesive layer (11) is designed as a metal adhesive layer (11) and/or that the second adhesive layer (14) is formed as a metal adhesive layer (14).

3. The layer system according to claim 1, wherein the protective layer (13) and the running-in layer (17) are formed as ceramic layers (13, 17).

4. The layer system according to claim 3, wherein the protective layer (13) and/or the running-in layer (17) are formed with aluminum oxide and/or zirconium oxide.

5. The layer system according to claim 1, wherein the running-in layer (17), in contrast to the protective layer (13), has a porosity or a higher porosity than the protective layer (13).

6. The layer system according to claim 1, wherein:

the rotor (6) is mounted in a rotatable manner relative to the stator (2); and the stator, rotor and layer system are incorporated in a compressor (1).

7. A method for producing a layer system (10) for the rotor/stator seal of a turbomachine (1), in particular a compressor (1), the layer system being disposed between components (2, 6) of the turbomachine (1) and being capable of being run in with a movement of the components (2, 6)

relative to one another, in such a way that at least one of the components (2, 6) is run into the layer system, wherein the components (2, 6) are configured as a stator (2) and a rotor (6) of the turbomachine (1), the method comprising the steps of:

providing a stator (2) and a rotor (6);

introducing a first adhesive layer (11) onto at least the rotor;

introducing a protective layer (13) onto the first adhesive layer (11);

introducing a second adhesive layer (14) onto the protective layer (13); and introducing a running-in layer (17), which is formed softer than the protective layer (13), on the second adhesive layer (14);

wherein the stator (2) is able to be run into the layer system (10).

* * * * *